33-255 SR
5/16/78 XR 4,089,318

United States Patent [19] [11] 4,089,318
Hesener [45] May 16, 1978

[54] SPRING TYPE ARTICLE PROJECTING DEVICE

[76] Inventor: Walter Hesener, 66, rue de la Prulay, 1217 Meyrin-Geneve, Switzerland

[21] Appl. No.: 643,741

[22] Filed: Dec. 23, 1975

[30] Foreign Application Priority Data

| | | |
|---|---|---|
| Jan. 9, 1975 | Switzerland | 291/75 |
| Feb. 13, 1975 | Switzerland | 1797/75 |
| Mar. 14, 1975 | Switzerland | 3398/75 |
| May 12, 1975 | Switzerland | 6170/75 |
| Oct. 30, 1975 | Switzerland | 14082/75 |

[51] Int. Cl.[2] ..... F41B 7/00
[52] U.S. Cl. ..... 124/16; 124/37; 224/5 D; 235/1 B; 124/80; 403/305; 33/255
[58] Field of Search ..... 124/16, 7, 26, 27, 37, 124/38, 80, 41 R, 45; 273/129 GA, 129 GB, 129 HA, 101 R, 32 D, 69, 56; 235/1 B, 82 R; 224/5 D; 128/DIG. 15; 42/1 S; 310/14, 23, 24, 34, 35; 74/99 R, 100 R; 33/256, 255, 257

[56] References Cited

U.S. PATENT DOCUMENTS

| | | | |
|---|---|---|---|
| 689,586 | 12/1901 | Haskell | 273/69 |
| 899,448 | 9/1908 | Grobl | 124/27 |
| 1,412,625 | 4/1922 | Nelson | 124/41 R UX |
| 2,001,449 | 5/1935 | Bergstrom | 273/129 GA |
| 2,305,176 | 12/1942 | Littman | 124/37 UX |
| 2,364,141 | 12/1944 | Harris | 273/129 HA X |
| 3,819,907 | 6/1974 | Faber | 235/1 B |

*Primary Examiner*—William R. Browne
*Attorney, Agent, or Firm*—Fleit & Jacobson

[57] ABSTRACT

A spring type article projecting device for propelling an object, at a target, is disclosed. The device comprises a stock, a handle and a striker head housing that includes a striker plate actuated by a striker pin. A force deflector member, pivotally mounted within the striker head housing, transfers the striker pin impact to the striker plate. A cocking member is provided which may be moved manually into various positions against the action of a spring. The invention provides a spring type article projecting device which is very simple in construction, is functionally-reliable and which is safe in its use and provides striking qualities superior to known apparatus.

17 Claims, 15 Drawing Figures

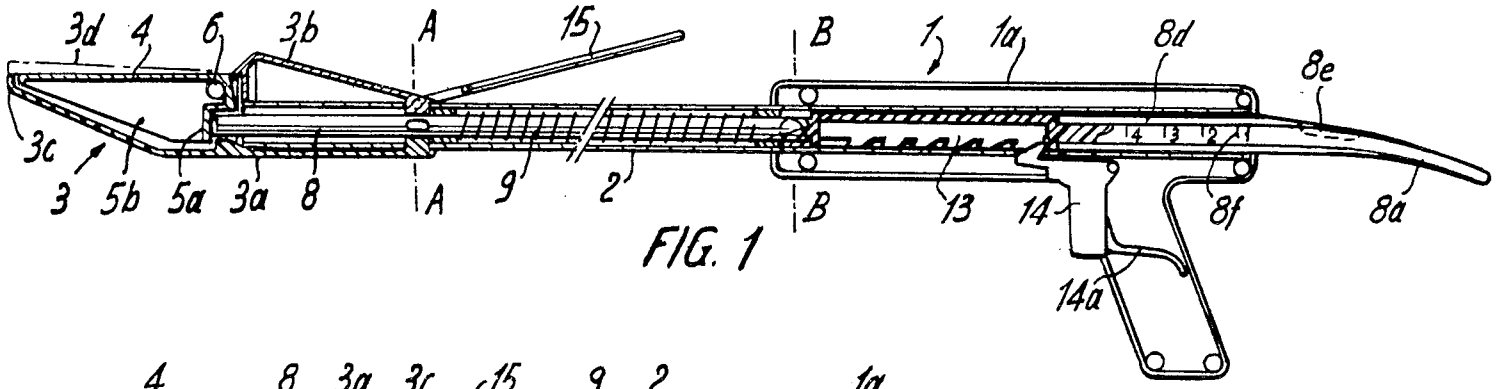
FIG. 1
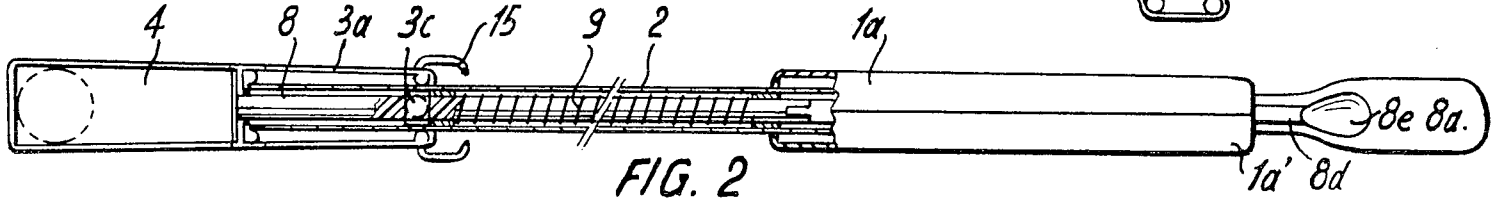
FIG. 2
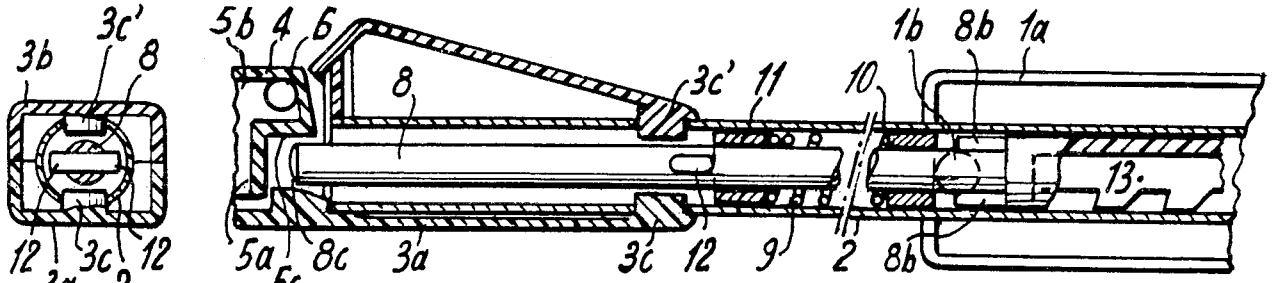
FIG. 3
FIG. 4
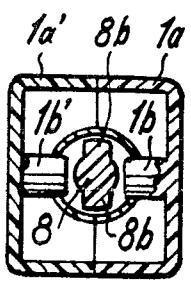
FIG. 5

SPRING TYPE ARTICLE PROJECTING DEVICE

The present invention relates to a striker device provided with a cockable and releasable mechanical percussion device. Such a striker device may be used to hit a ball into a target hole, through obstacles and the like. In general terms, such a striker device may comprise a stock, one end (usually the upper end) of which is provided with a handle and another end (usually the bottom end) of which continues into a striker head housing, the mechanical percussion device having, mounted on a long side of the striker head housing a striker plate which is mounted for movement transversely with respect to the longitudinal direction of the stock. Such a striker device also has a cocking means which can be moved manually into various positions against the action of a springing means and which can be manually released.

Hitherto, endeavours to achieve a usable striker of the above type have proved unsuccessful. Suggested constructions which have been proposed are entirely unsatisfactory from the point of view of their manner of operation. For example they do not allow an interesting and differentiated ball manipulation and to some extent have disadvantages from the safety point of view.

The present invention is directed to the need for a striker device which is characterised by a very simple, functionally-reliable and accident proof construction, attractive operational features and good striking qualities, which can at the same time be manufactured and sold at a competitive price.

In accordance with one aspect of this invention; there is provided a striker device having a cockable and releasable mechanical percussion device for hitting an object such as a ball in a desired direction, the said striker device comprising: a stock, one end of which is provided with a handle and the other end of which continues into a striker head housing, the mechanical percussion device having, mounted on an elongated side of the striker head housing, a striker plate which is mounted for movement transversely with respect to the longitudinal direction of the stock; a cocking member which can be moved manually into selected positions against the action of a spring means; means for manually releasing the cocking member, said cocking member having a striking end formed by a striker pin; a force deflector member in the form of an angle lever and disposed between the striker plate and the striker pin, said deflector member being mounted rotatably in the striker head housing and having a first angular position which is independent of the possible cocked positions of the striker pin, said position being occupied by the lever prior to its striking movement; the force deflecting member, upon receipt of an impact from the striker pin, being deflected and so causing a striking movement of the striker plate.

In accordance with a second aspect of this invention, there is provided a striker device having a cockable and releasable mechanical percussion device for hitting an object such as a ball in a desired direction, the said striker device comprising: a stock, one end of which is provided with a handle and the other end of which continues into a striker head housing, the mechanical percussion device having, mounted on an elongated side of the striker head housing, a striker plate which is mounted for movement transversely with respect to the longitudinal direction of the stock; a cocking member which can be moved manually into selected positions against the action of a spring means, means for manually releasing the cocking member; wherein the latter is helically surrounded by said spring means; wherein the cocking member is disposed at least partly, within a tubular housing which connects the handle and the striker head housing and is capable of longitudinal and non-rotatable movement relative thereto under the influence of the spring means; wherein the, cocking member has rigidly secured thereto at least one laterally-extending first dog at each end of the spring means; and wherein at least the handle or the handle end of the tubular housing has on and rigidly secured to its inner wall at least one laterally-extending second dog which is angularly offset in relation to the first dog.

In accordance with a third aspect of this invention, there is provided a striker device having a cockable and releasable mechanical percussion device for hitting an object such as a ball in a desired direction, and comprising a stock, one end of which is provided with a handle and the other end of which continues into a striker head housing; said striker device being in combination with a plurality of obstacles which are to be placed rigidly upon a playing surface and having a long narrow case attached to the said stock and parallel thereto, the said obstacles and parts thereof being each of substantially rod-shape so that they can be accommodated within said long narrow case.

The invention as well as the advantages resulting therefrom will be better understood from the ensuing description of illustrative examples of embodiments according to the invention, as shown in the attached drawings, in which:

FIG. 1 shows a longitudinal section through a striker according to the invention;

FIG. 2 is a partly sectional plan view;

FIG. 3 shows the middle portion of FIG. 1 (enlarged);

FIG. 4 shows a section on the line A—A according to FIG. 1 (enlarged);

FIG. 5 shows a section on the line B—B according to FIG. 1 (enlarged);

Figures 6, 7, 8, 9, 10, 11, 12, 13, 14, 15:
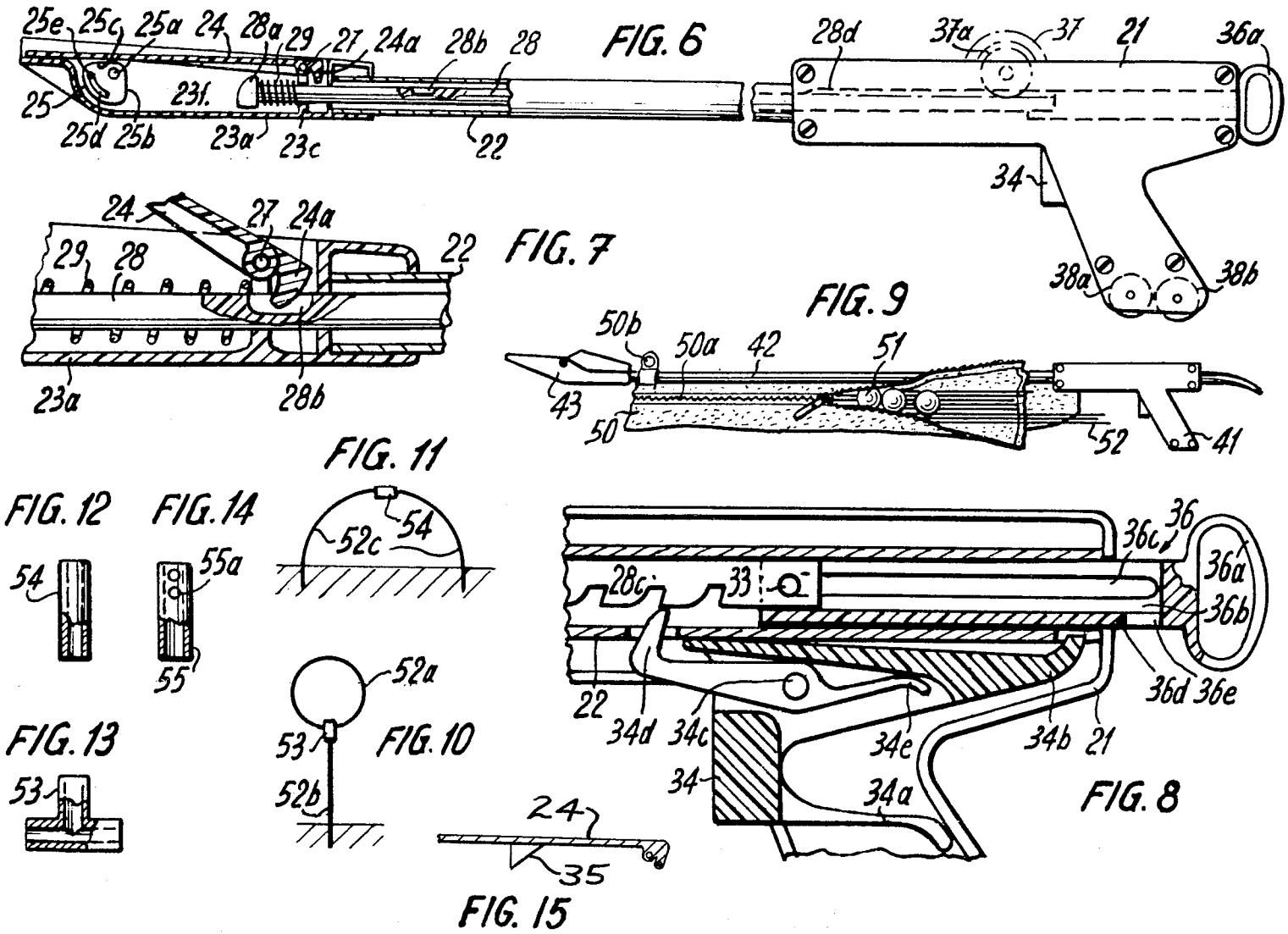
FIG. 6 is a side view of an alternative embodiment.
FIG. 7 shows a striker head zone according to FIG. 6 (enlarged)
FIG. 8 shows the rear opened hand grip zone according to FIG. 6.
FIG. 9 shows a striker with accessory bag.
FIGS. 10 to 14 show game accessories in the form of obstacles.
FIG. 15 shows an alternative embodiment of the force deflecting angle lever employed in the practice of the invention.

In accordance with FIGS. 1 to 5, the handle 1 consisting of housing shells 1*a*, 1*a'* is connected via the tubular member 2 to the striker head housing 3 which consists of the housing shell 3*a* and the bearing cap 3*b*. To secure the position of the tubular member 2, projecting housing studs 3*c*, 3*c'* and 1*b*, 1*b'* project through corresponding bores in the tubular member. The striker plate 4 extending in the longitudinal direction of the tubular member is integrally moulded as a longitudinal arm on a pivotable angle lever which for the rest consists of the transverse arm 5*a* extending rearwardly in the region of the bearing spindle 6,and the longitudinal arm 5*b* which extends at right-angles to the bearing spindle 6, connecting the two arms 4 and 5*a* to each other in the form of a conically tapering rib. The striker plate 4 closes off like a cover the zone of the housing shell 3*a* which narrows in a wedge shape as far as the edge 3*c*. The striker pin 8 extends from the handle 1 through the tubular member 2 and into the striker head housing 3. The end 8*a* which protrudes from the handle 1 is constructed as a pull grip. The thrust spring 9 surrounding the striker pin 8 is preceded by the two spacers 10 and 11. For axial restriction of the spring, the striker pin 8 has at the striker head end the dogs 12 formed by the ends of a transverse pin and at the handle end the directly integrally moulded dogs 8*b*. In the longitudinal direction of the tubular member, the distance measured between the striker pin dogs 8*b* and 12 corresponds more or less to the distance measured in the same direction between the housing dogs 1*b* and 3*c*. The striker pin dogs 8*b*, 12 are in each case angularly offset with respect to the housing dogs 1*b*, 3*c*. The functional action resulting from the reciprocal disposition of the spring 9, the dogs 8*b*, 12 and the studs 1*b*, 3*c* will become evident from a later portion of the description.

Mounted in a zone of the striker pin which follows on from the dogs 8*b* is a ratchet strip 13 which co-operates with the releasing member 14 which is manually pivotable against the spring 14*a*. Since the ratchet recesses are not formed directly on the striker pin 8, only the ratchet strip 13 need consist of correspondingly high grade material. Above the ratchet strip 13, the striker pin 8 is provided with a cruciform profile 8d which in conjunction with matching guide 1*b* on the housing, secures the striker pin against rotation. The plate-shaped pull grip 8a is curved slightly rearwardly and has at the top a recess for the thumb. For safety reasons, sharp edges, steps, etc., are avoided.

The striker works as follows:

The dogs 8*b*, 12 and the studs 1*b*, 3*c* provide for the striker pin 8 the basic position shown in FIG. 1 in which the bottom end of the striker pin 8*c* is disposed minimally above the transverse arm 5*a* of the force deflecting angle lever 5*a*, 5*b* which is in the starting position. Cocking of the striker pin 8 by means of the pull grip 8*a* causes the dogs 12 to compress the spring 9 which is braced at the top against the housing studs 1*b*. Subsequent actuation of the release lever or trigger 14 causes the striker pin 8 to be accelerated by the tensed spring 9. Shortly before the striker pin end 8*c* strikes the transverse arm 5*a*, the spring 9 is arrested by the housing studs 3*c*, 3*c*'. By virtue of the kinetic energy of the striker pin 8, this latter however continues to move, strikes hammer-like on the transverse arm 5*a* and so pivots the striker plate 8 through a few degrees, i.e. until a lateral stop 5*c* integrally moulded on the transverse arm 5*a* strikes laterally against the striker pin end. At the moment when the striker pin end 8*c* strikes the transverse arm 5*a*, the striker pin dogs 8*b* move at speed past the housing studs 1*b*, 1*b*' and strike the spacer 10. Consequently, the blow is dampened. Immediately after impact, the spring 9 restores the striker pin 8 to its starting position. In consequence, by reason of its gravity action or a small restoring spring (not shown), also the striker plate resumes its initial position. The housing studs 1*b*, 1*b*' can also serve as an end stop for the striker pin 8.

This embodiment of striker, by reason of its structural simplicity and functional advantages, constitutes an optimum solution. Particularly with regard to the interaction between the cocking member, constructed as a striker pin 8, and the striker plate, mechanical complication, wear and friction loss are reduced to an absolute minimum. By virtue of the hammer-like blows from the spring force accelerated striker pin 8, acting on the striker plate 4, the striker plate velocity is immediately very high. The pivoting angle of the striker plate can thus remain limited to a few angular degrees. Therefore, the ball receives a very short and hard blow with a virtually radial initiation of force (no sliding or rolling of the ball off the striker plate). Shot action and accuracy of aim are therefore very good despite the pivoting mounting of the striker plate. The least possible pivoting angle is also advantageous on reasons of safety or in the interest of small striker head dimensions.

The very slim construction of the under part of the striker head, tapering wedge-like to one edge, a construction which is achieved in spite of the plurality of ratchet positions, is particularly advantageous. Resulting from this, it is possible as desired and with a surprising accuracy of aim, to carry out short, wide, flat and steep shots. The striker pin 8 does not protrude into the space in the housing located behind the striker plate 4. Therefore, the striker plate can without risk be opened up so that this space can be cleaned while the striker pin 8 is cocked. 3*d* denotes one of two protective walls shown by broken lines in FIG. 1, which can be integrally moulded on the long side of the striker plate 4 of the housing shell 3*a*.

The special disposition of the spring 9 is also extremely advantageous from the point of view of assembly. Since the dogs 12 are formed by the ends of a transverse pin, the spring 9 is mounted on the striker pin 8 in such a way that it is ready to function, before the striker pin 8 is pushed into the tubular member 2. This means a maximum possible diminution of assembly time and materials.

FIGS. 1 and 2 also show an aiming rod 15, the fork-shaped fitment end of which is fixed in outwardly and inwardly pivotable manner on the striker head housing 3.

Whichever ratchet position is set can be seen from the scale 8*f* on the striker pin 8.

In the case of the striker shown in FIGS. 6 to 8, the force deflecting angle lever which is mounted to pivot about the spindle 25*a* is designated by reference numeral 25. Its transverse arm 25*b* co-operates with the striker pin end 28*a* while its longitudinal arm 25*c* reproduces the force pulses only by reciprocal bearing on the striker plate 24 which is mounted to pivot about the spindle 27. The thrust spring 29 is disposed inside the striker head housing 23*a*, where it is braced against the striker pin end 28*a* and the housing ribs 23*c*. The angle lever 25 also comprises the curved elongated hole 25*d* through which passes a pin 25*e* secured in the side walls of the striker head housing 23*a* and serving as an end stop. The slight pivoting angle of the striker plate 24 is limited by the stop arm 24*a* which acts against the lateral face of the striker pin 28. This is also provided with a recess 28*b*. In the first ratchet position of the striker pin 28, this lies at the level of the stop arm 24*a* and so permits of a wide pivoting out of the striker plate 24 to allow cleaning of the space 23*f*. The locking action which occurs thereby between the stop arm 24*a* and the recess 28*b* excludes any risk of danger from the striker pin 28.

Also in this embodiment of striker head, the spring 29 can be disposed in the tubular member 22 in accordance with FIGS. 1 to 5.

As shown in FIG. 15, the force deflecting angle lever can also be integrally moulded directly on the lower zone of the striker plate 24. It has an oblique face towards the striker pin 28 and by which it co-operates therewith. However, a certain loss of power must be expected in this simple solution.

As an alternative to the pivoting spindle 27, the striker plate 24 may be of self-springing construction over at least a part of its length.

As FIG. 8 shows, the pull member 36 which is provided with the pull grip 36*a* is telescopically displaceably connected to the ratchet zone 28*c* of the striker pin. It has a T-shaped profile, around the T-shaped longitudinal web 36*b* of which the ratchet zone 28*c* of U-shaped cross-section engages. The connection is guaranteed by the longitudinal slot 36*c* and the transverse pin 33. In the cross-member 36*d* of the T is the recess 36*e*. The arm 34*b* of the releas e member 34 co-operates therewith, being mounted to pivot about the spindle 34*o* and against the restoring spring 34*a*. Actuation of the release member 34 is possible only when the pull member 36 is in the pushed-in position. Thus, it does not carry out the working movement of the striker pin 28, which further enhances the safety of the striker. With this locking arrangement, in order to allow the cocking process, the ratchet pawl 34*d* is constructed as a separate lever mounted on the same axis as the release member 34 and pushed into its locked position by the spring 34*e* moulded integrally thereon. The mode of action of the ratchet lever 34*d* will be understood without further explanations.

FIG. 6 also shows that the striker pin 38 can also be cocked via a gear drive. Reference numeral 37 denotes a rotary knob mounted laterally of the handle 21 on the stub of a spindle of a gearwheel 37*a*. This engages the indicated teeth 28*d* of the striker pin. The force which has to be applied depends upon the transmission ratio selected. Thus, an easier cocking can be achieved by this solution. During the rapid forward movement of the striker pin, the rotary knob 37 performs only a rotary movement which is harmless to the operator, and which would be avoidable by using coupling means.

38*a* and 38*b* denote two discs of a counting device for registering the number of shots performed. The disc 38*a* is for example the digits and the disc 38*b* the tens disc. They are coupled to each other in conventional manner. They could also be automatically actuated, for example by the release member 34.

In the case of the striker shown in FIG. 9, there is attached to the tubular member 42 extending between the handle 41 and the striker head 43 an elongated case 50 provided with a sliding clasp fastener 50*a* and secured by means of press stud fastened loops 50*b*. It serves to accommodate accessories in the form of balls 51, rods 52 and connecting sleeves, not shown, for connecting the rods. At least some of these rods consist of such elastic and thin profiles that they can if necessary be shaped into circles or gate curves and may, when not in use, be stored in more or less straightened form in the bag 50.

FIG. 10 shows a circular obstacle. The ring 52*a* bent from one of the rods 52 is mounted by means of a T-shaped connecting sleeve 53 on another, thicker rod 52*b* which is pushed into the ground. By using two rods and an additional connecting sleeve, a ring of twice the diameter may be formed. Also the ring 52*a* can be disposed at various heights by fitting a plurality of supporting rods 52*b* one upon another.

FIG. 11 shows a larger curved gate obstacle. It consists of the two rods 52*c* which are connected at the top by connecting sleeve 54 and the bottom ends of which are fixed in the ground. Small curved gates can be formed by using only one rod.

FIGS. 12 to 14 show three different types of connecting sleeve. FIG. 12 shows the simpler connecting sleeve 54 corresponding to FIG. 11.

FIG. 13 shows the T-shaped connecting sleeve 53 corresponding to FIG. 10.

The connecting sleeve 55 according to FIG. 14 has the two transverse bores 55*a*. In the case of ring-shaped obstacles and despite a pre-determined rod length, it allows the diameter of the ring to be made smaller at will.

The ring 52*a* according to FIG. 10 can also be orientated obliquely or horizontally as desired. Furthermore, it can be fitted with a ball catching net, not shown.

The game value of a striker with a mechanical percussion device is substantially enhanced by the accessories according to the invention. The extremely inexpensive, rapidly set-up obstacles which vary in size, shape, height, etcetera, make the game particularly exciting. There is no problem accommodating them in the bag. At least during storage and transportation, striker and accessories form one unit.

The construction of the means of connecting the obstacle rods depends naturally on the profile of rod used. For tubular profiles, the connecting elements may have connecting studs instead of sleeve-shaped connections or bores. By reason of its great elasticity, a flat rod profile is also eminently suitable.

Other possible shapes for the obstacles are for example triangle and rectangle. The obstacles can be arranged either directly on the playing surface, or pushed into the ground, as with the curved gate, or on one or more mounting rods, as with the circular ring. For the angular forms of obstacle, of course it is not necessary to have rods with any particular flexibility.

An alternative kind of fixed emplacement for the obstacles can be arranged by using a socket member in the form of a plate.

I claim:

1. An article projecting apparatus having a cockable and releasable mechanical percussion mechanism for hitting an object, such as a ball, in a desired direction, said apparatus comprising: a stock having first and second ends, the first end having an integral extension comprising a handle and the second end having an integral extension comprising a stricker head housing, a striker plate positioned on an elongated side of said striker head housing and pivotally mounted thereon for movement transversely with respect to the longitudinal direction of the stock; a cocking member positioned within said stock and adapted to be moved manually into selected positions against the action of a spring means; means for manually releasing the cocking member from said selected positions; said cocking member including a striking pin which has a striking end; a force deflector member in the form of an angle lever and disposed below the striker plate when the apparatus is in a horizontal position and said stricker plate faces upwardly, said deflector member being rotatable about a fixed axis in the striker head housing and having a first angular position which is independent of the possible cocked positions of the striker pin, said positions being occupied by the stricking pin prior to its striking movement, the force deflecting member, upon receipt of an impact from the striker pin, being deflected and causing a ball striking movement of the striker plate; said striker plate having a rest position independent of the positions to which the cocking member is moved, said striker head housing having to a terminal edge which is adjacent to a forward or the lower most free end of said striker plate when the deflector member is not engaged by the striker pin, the movement of the striker plate being such that a ball positioned adjacent said striker head housing is engaged from behind when the apparatus is in an operative position by insertion of the edge and the free end of said striker plate under a portion of the circumference of a ball.

2. The apparatus in accordance with claim 1 wherein said striker plate is pivotally mounted on said striker head housing, and further comprising a stop carried by said striker plate and positioned to co-operate with a lateral surface of the striker pin to limit the angular pivoting movement of said striker plate.

3. The apparatus in accordance with claim 1 wherein the striker pin has a lateral recess which, in any of its ratchet-determined positions, is at a predetermined location in relation to the stop on the striker plate, the said recess by receiving the stop, allowing an opening pivoting movement of the striker plate with respect to the striker head housing thereby constituting a safety interlock between striker pin and striker plate when the striker head housing is open.

4. The apparatus in accordance with claim 1 wherein the striker pin has, rearwardly of the ratchet means, a cross-sectional profile which is non-circular and which co-operates with a complementary aperture in a wall of the handle to prevent relative rotation between the handle and the striker pin.

5. The apparatus in accoradance with claim 1 and further including a tension member separate from the striker pin and co-operating telescopically within the handle with an end portion of the striker pin, the tension member having an operating or gripping end protruding from the rear of the handle, there being provided a manually-operable trigger and an interlocking mechanism to ensure that the trigger is locked in place when the tension member is pulled out to cock the cocking member and to ensure that the trigger can only be operated when the tension member has been returned into the handle.

6. The apparatus in accordance with claim 1 wherein the striker pin has a ratchet strip positioned to co-operate with a manually-operable trigger, the said ratchet strip consisting of a more durable material than that used for the remainder of the striker pin.

7. The apparatus in accordance with claim 1 wherein the striker pin includes a manually operable pull grip for cocking said striker pin, said grip being formed by the upper end region of the striker pin which protrudes rearwardly from said handle and which is of a flat and slightly rearwardly curved strip-like configuration, and said grip having at least one top depression to accommodate a thumb of a user.

8. The apparatus in accordance with claim 1 wherein said striker pin comprises an elongated pin having first and second ends, the first end of said pin comprising the striker end thereof, the second, opposed end thereof having an integral extension continuing therefrom and including a manually operable pull grip, at least a portion of said grip having a scale for indicating the extent of the cocking movement of said cocking member.

9. The apparatus in accordance with claim 1 wherein said striker head housing has lateral walls which overlap the lateral edges of the striker plate and project in the striking direction.

10. The apparatus in accordance with claim 1 wherein the striker plate and the angle lever are integral.

11. The apparatus in accordance with claim 10 wherein said striker plate comprising a longitudinally-extending arm of said angle lever and is integral therewith.

12. The apparatus in accordance with claim 10 wherein the striker plate is pivotally mounted on the striker head housing, said striker plate further comprising a cam integrally moulded on the rear thereof, said cam having an oblique face which faces towards and is in operation engaged by the striker pin.

13. The apparatus in accordance with claim 10 wherein the striker plate is pivotally mounted on the striker head housing, wherein a transverse arm is integrally moulded on the rear of the striker plate in the region of its pivot bearing, and wherein said transverse arm intersects the path of movement of the striker pin, the adjacent surfaces of the striker plate and of the transverse arm being connected to each other by at least one longitudinal rib, said transverse arm being shorter than the said striker plate.

14. The apparatus in accordance with claim 13 wherein a stop is integrally moulded on said transverse arm.

15. The apparatus in accordance with claim 1 and further comprising a sight secured to the stock by means of a pivot bearing and capable of being swung out away from the stock ready for use.

16. The apparatus in accordance with claim 1 wherein said cocking member is disposed, at least partly, within a tubular housing comprising said stock and which connects the handle and said striker head housing and is capable of longitudinal and non-rotatable movement relative thereto under the influence of said spring means; said cocking member further having rigidly secured thereto at least one laterally-extending first dog positioned at each end of the spring means; the handle end of the tubular housing having ridigly secured to its inner wall, at least one laterally-extending second dog which is angularly offset in relation to the first dog; a force deflector member in the form of an angle lever and disposed below the striker plate, said deflector member being rotatably positioned in the striker head housing and having a first angular position which is independent of the possible cocked positions of the striker pin.

17. The apparatus in accordance with claim 16 wherein said second dog or dogs are formed by inwardly projecting studs which project from the striker head housing and through a corresponding aperture or apertures in the tubular housing, thereby serving in addition to secure the position of the tubular housing with respect to the striker head housing and the handle.

* * * * *